US007287569B2

(12) United States Patent
Lin

(10) Patent No.: US 7,287,569 B2
(45) Date of Patent: Oct. 30, 2007

(54) TILT AND LIFT DEVICE FOR ADJUSTING TILT ANGLE AND HEIGHT OF SLATS OF A VENETIAN BLIND

(76) Inventor: Gwo-Tsair Lin, No. 3-1, Lane 369, Wanli Rd., Tainan City 702 (TW)

( * ) Notice: Subject to any disclaimer, the term of this patent is extended or adjusted under 35 U.S.C. 154(b) by 287 days.

(21) Appl. No.: 11/119,776

(22) Filed: May 3, 2005

(65) Prior Publication Data

US 2006/0249264 A1 Nov. 9, 2006

(51) Int. Cl.
*E06B 9/303* (2006.01)

(52) U.S. Cl. ..... 160/170; 160/176.1 R

(58) Field of Classification Search ..... 160/171, 160/170, 168.1 R, 173 R, 178.1 R, 176.1 R, 160/177 R
See application file for complete search history.

(56) References Cited

U.S. PATENT DOCUMENTS 5,103,888 A * 4/1992 Nakamura ..... 160/171
5,184,660 A * 2/1993 Jelic ..... 160/171
5,645,118 A * 7/1997 Lagarde ..... 160/170
5,908,062 A * 6/1999 Fun ..... 160/170
6,659,156 B2 * 12/2003 Wen et al. ..... 160/168.1 P
6,662,850 B2 * 12/2003 Chung et al. ..... 160/171
6,918,424 B2 * 7/2005 Lin ..... 160/171
7,096,918 B2 * 8/2006 Lin ..... 160/171

* cited by examiner

*Primary Examiner*—David Purol
(74) *Attorney, Agent, or Firm*—Rosenberg, Klein & Lee

(57) ABSTRACT

A Venetian blind includes a control, a square transmission shaft joined to the control, an external tube, and a reel tube having an external spiral groove, along which a lift cord is wound; the external tube has two elongate protrusions parallel to an axis thereof on an outer side; the elongate protrusions define a tunnel in between, and have opposing gaps on the edges thereof, and they are formed with such a shape that a lengthways-extending aperture is provided between edges thereof; a tilt cord is passed over, and joined to the external tube with a middle knot thereof being detained in the tunnel of the external tube, and with two ends thereof being passed through the gaps of the elongate protrusions of the external tube; thus, the tilt cord will always move together with the external tube.

3 Claims, 11 Drawing Sheets

TILT AND LIFT DEVICE FOR ADJUSTING TILT ANGLE AND HEIGHT OF SLATS OF A VENETIAN BLIND

BACKGROUND OF THE INVENTION

1. Field of the Invention

The present invention relates to a tilt and lift device used for adjusting height and tilt angle of a Venetian blind, more particularly one, which can be smoothly operated even if the original tilt cord and lift cord thereof are replaced with thicker tilt cord and lift cord suitable for use with Venetian blinds with large and heavy slats.

2. Brief Description of the Prior Art

Referring to FIGS. 1 and 2, a conventional tilt and lift device of a Venetian blind includes a manual control member (not shown), a supporting base 10, a support 20, a reel tube 30, an external tube 40, and a transmission shaft (D).

The manual control member is secured on an uppermost part of a door (window), and connected to the transmission shaft (D) such that the transmission shaft (D) can be turned in a selected direction by means of operating the manual control member. The supporting base 10 is securely held in a horizontal elongate part (C) on an upper part of the door (window), and it has a holding space 101, a through hole 102, and a locating portion 103 next to the through hole 102. The support 20 is secured to the locating portion 103 of the supporting base 10, and it has a passage 201, and internal threads. The reel tube 30 has a continuous spiral groove 301 on an outer side, and a hole 302 near to a first end. A lift cord is passed through the hole 302, and formed with a knot at an inner end, and wound along the continuous spiral groove 301 of the reel tube 30. The reel tube 30 is positioned horizontal in the holding space 101 of the supporting base 10, and passed through the passage 201 of the support 20 while the lift cord is passed through the through hole 102 at the other end, passed through the slats of the Venetian blind, and joined to a lowermost one of the slats. The external tube 40 has an annular groove 401 on one end, and it is positioned horizontal in the holding space 101 of the supporting base 10 with the reel tube 30 being passed into it. A tilt cord is passed over the external tube 40, and held in the annular groove 401 at a middle portion, and joined to front edges of the slats at a front portion, and joined to rear edges of the slats at a rear portion. The transmission shaft (D) is passed through and joined to both the external tube 40 and the reel tube 30 such that the tubes 30 and 40 will turn together with the transmission shaft (D). Because of friction between the external tube 40 and the tilt cord, which is passed over the external tube 40, and held in the annular groove 401, the tilt cord will be slightly moved when the external tube 40 is turned.

Thus, height and tilt angle of the Venetian blind can be changed by means of operating the manual control member to turn the transmission shaft (D). Because of the external threads of the reel tube 30 and the internal threads of the support 20, the reel tube 30 will move linearly relative to the support 20 when it is turned. If the user wants to adjust both the height and the tilt angle of the Venetian blind, he should adjust the height of the Venetian blind first; after the Venetian blind has been adjusted to a desired height, the user should operate the manual control member to make the external tube 40 slightly turn in a direction opposite to the last one such that the slats of the Venetian blind are adjusted to a desired tilt angle.

The above conventional tilt and lift device has the following disadvantages:

The device can only be used with a certain thickness of lift cord and tilt cord, as shown in FIG. 3; if the original lift cord is replaced with one with excessive thickness, the new one will be jammed between the external tube and the reel tube, as shown in FIG. 4, and the Venetian blind can't be smoothly moved; if the original tilt cord is replaced with a thicker one or a thinner one, there won't be enough friction between the new tilt cord and the external tube, as shown in FIG. 4, and the tilt angle of the slats can't be effectively adjusted. Consequently, the tilt and lift device can only be used with Venetian blinds lighter than a certain weight, and it can't be used with large and heavy Venetian blinds because the original lift cord and the original tilt cord thereof aren't strong enough.

Referring to FIG. 5, another tilt and lift device of a Venetian blind includes a manual control member (E), two tilt tubes 91, two reel tubes 92, and a transmission shaft. The transmission shaft is connected to the manual control member (E), the tilt tubes 91, and the reel tubes 92 such that the tilt tubes 91, and the reel tubes 92 will be turned when the manual control member (E) is operated. The reel tubes 92 are arranged outsides the tilt tubes 91; thus, when a thick lift cord is used in the place of the original one, it won't be jammed between the tilt tubes 91 and the reel tubes 92 to hinder rotation of the reel tube. And, lift cords are connected to the reel tubes 92 and the slats of a Venetian blind, and tilt cords are connected to the tilt tubes 91 and the slats. And, the tilt tubes 91 are made in such a way as to allow thick tilts cord to be used thereon instead of the original ones. Therefore, the second conventional tilt and lift device can be equipped with thick lift cords and tilt cords, and used with large and heavy Venetian blinds.

However, the second conventional device has a more complicated structure and higher manufacturing cost than the first one, and it takes more time and labor to assemble the second device. Therefore, the second conventional tilt and lift device isn't economical to use.

SUMMARY OF THE INVENTION

It is a main object of the present invention to provide an improvement on a tilt and lift device of a Venetian blind to overcome the above-mentioned problem. The tilt and lift device includes a manual control, a supporting base, a square transmission shaft joined to the control, a rotary ring, a torsion spring, a reel tube, and an external tube. The rotary ring has a square hole at first end. The torsion spring is tightly positioned on the rotary ring. The torsion spring has two ends for exerting force on. The external tube is angularly displaceable about the axis, and has several bar-shaped protrusions on an inner side, and a protrusion held between the two ends of the torsion spring. A tilt cord is passed over and joined to the external tube. The external tube will be stopped from turning beyond a certain position by the supporting base. The reel tube is passed into the external tube, with the bar-shaped protrusions of the external tube helping the reel tube keep balance, and has a square axial hole, and a continuous spiral groove, on which a lift cord is wound along. The reel tube engages an internal thread of a support ring at the spiral groove so as to be linearly displaceable when turning. The transmission shaft is passed through the external tube, and the square holes of the reel tube and the rotary ring. One of two ends of the torsion spring will be pressed against the protrusion of the external tube when the transmission shaft is turned. Thus, when the manual control is operated, the torsion spring will be slightly enlarged, and loosen its grip on the rotary ring after the external tube is stopped at said certain position by the supporting base, allowing the rotary ring, the transmission shaft, and the reel tube to be turned together.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
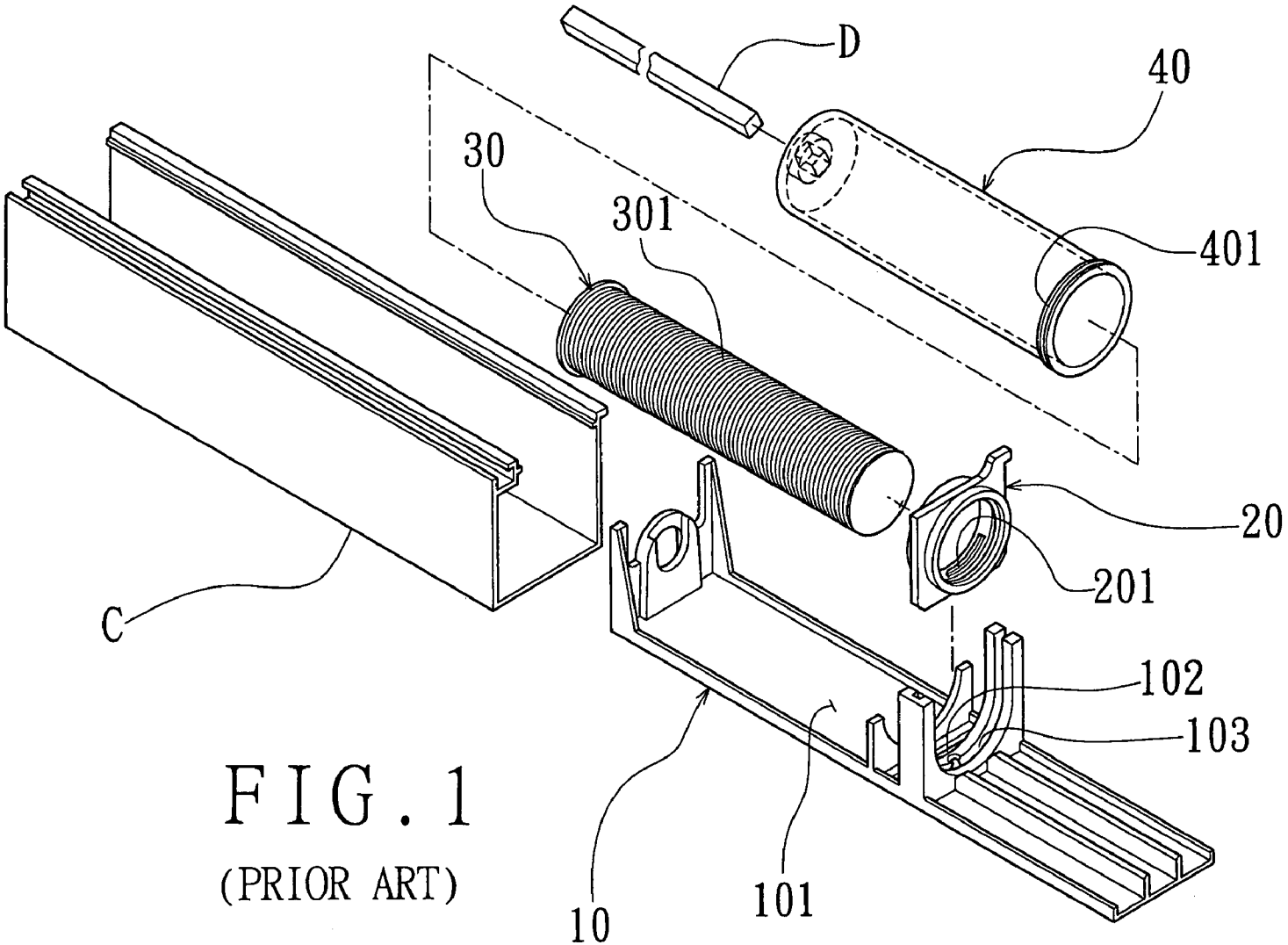
FIG. 1 (PRIOR ART)
FIG. 1 is a fragmentary exploded perspective view of the first conventional tilt and lift device of a Venetian blind.
Figure 2:
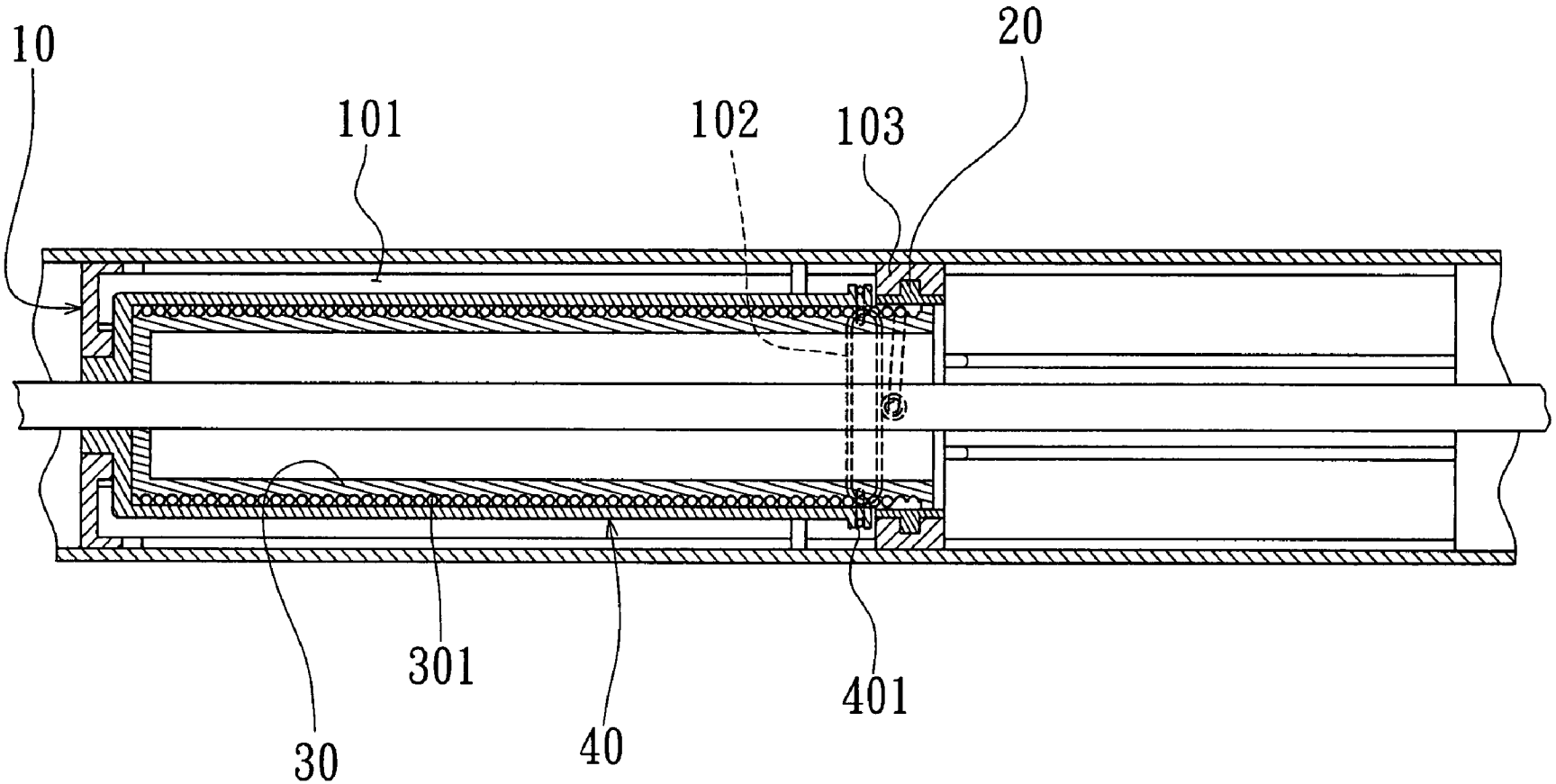
FIG. 2 (PRIOR ART)
FIG. 2 is a partial front sectional view of the first conventional tilt and lift device of a Venetian blind.
Figure 4:
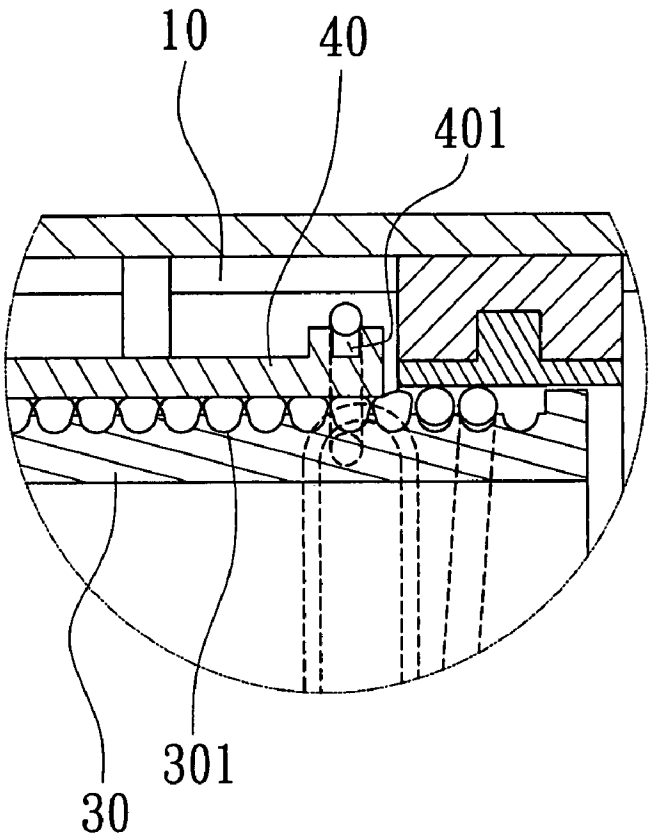
FIG. 4 (PRIOR ART)
FIG. 4 is a partial sectional view of the first conventional device, equipped with a tilt cord of improper thickness.
Figure 3:
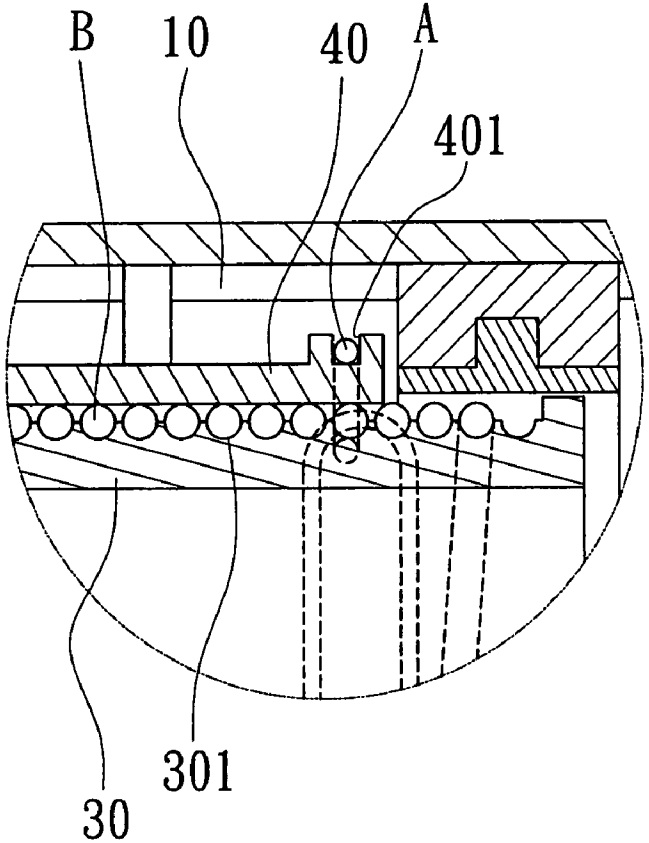
FIG. 3 (PRIOR ART)
FIG. 3 is a partial front view of the first conventional device.
Figure 5:
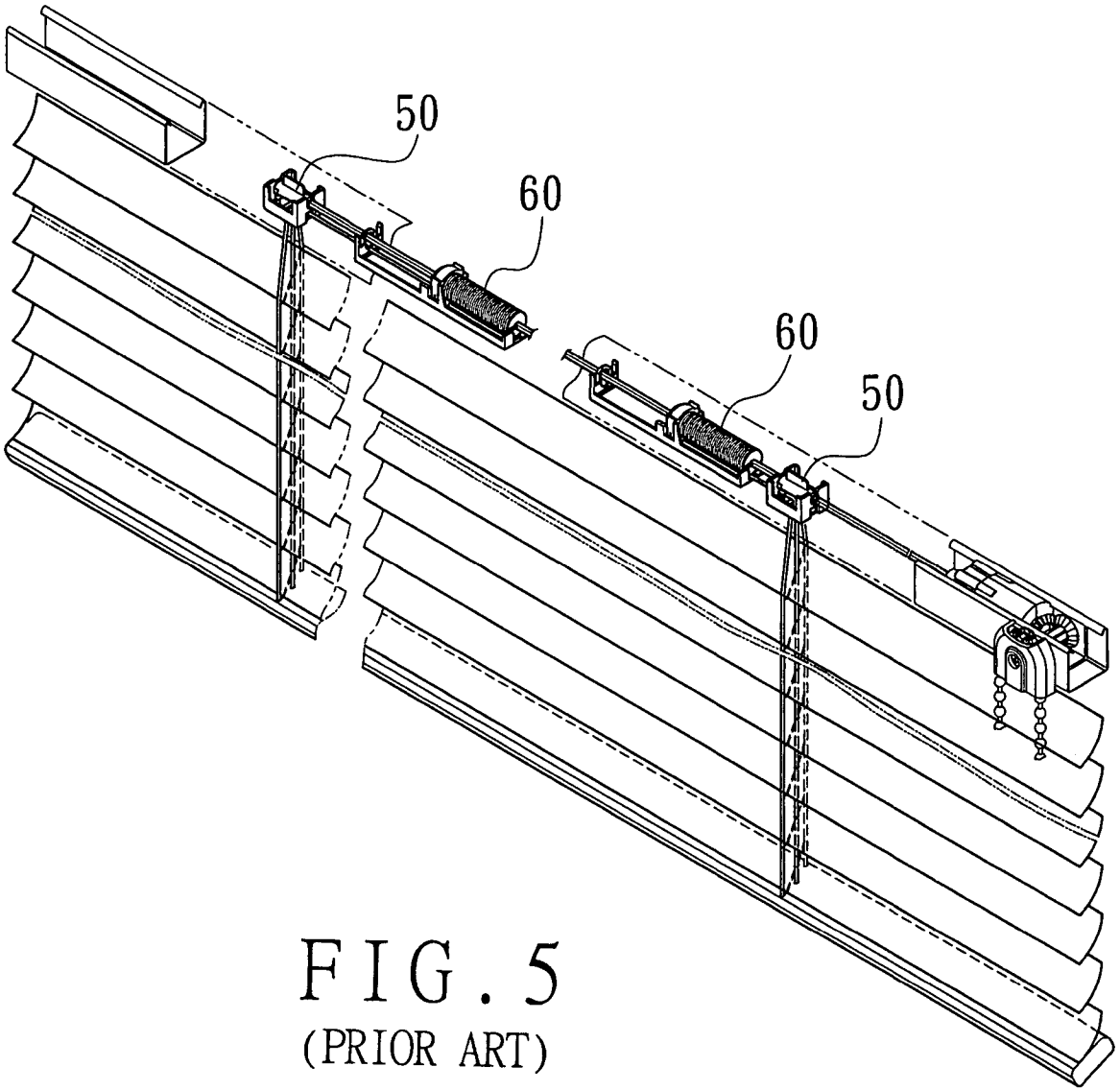
FIG. 5 (PRIOR ART)
FIG. 5 is a perspective view of a Venetian blind with the second conventional tilt and lift device.
Figure 6:
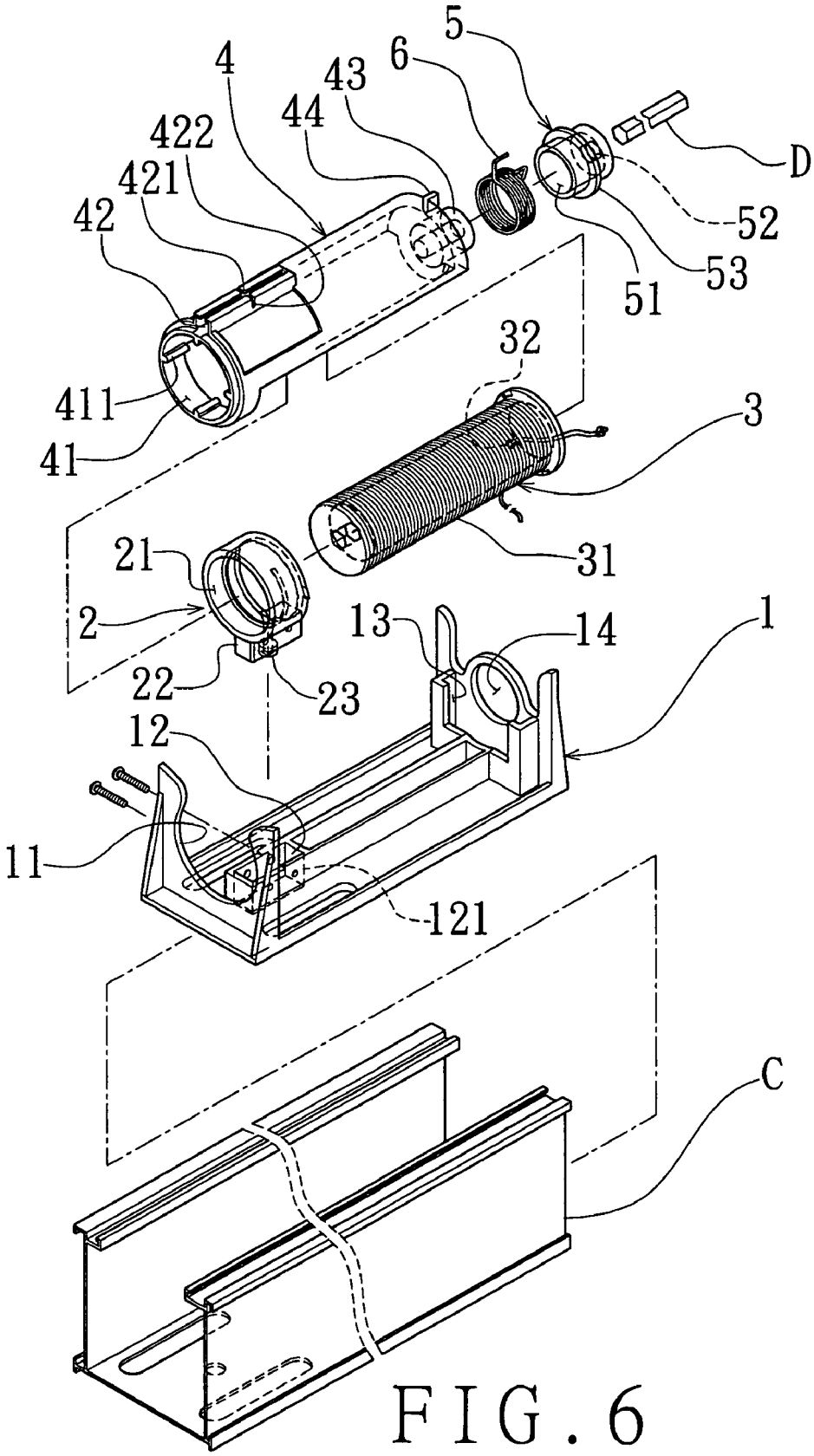
FIG. 6 is a fragmentary exploded perspective view of the tilt and lift device of a Venetian blind in the present invention.
Figure 8:
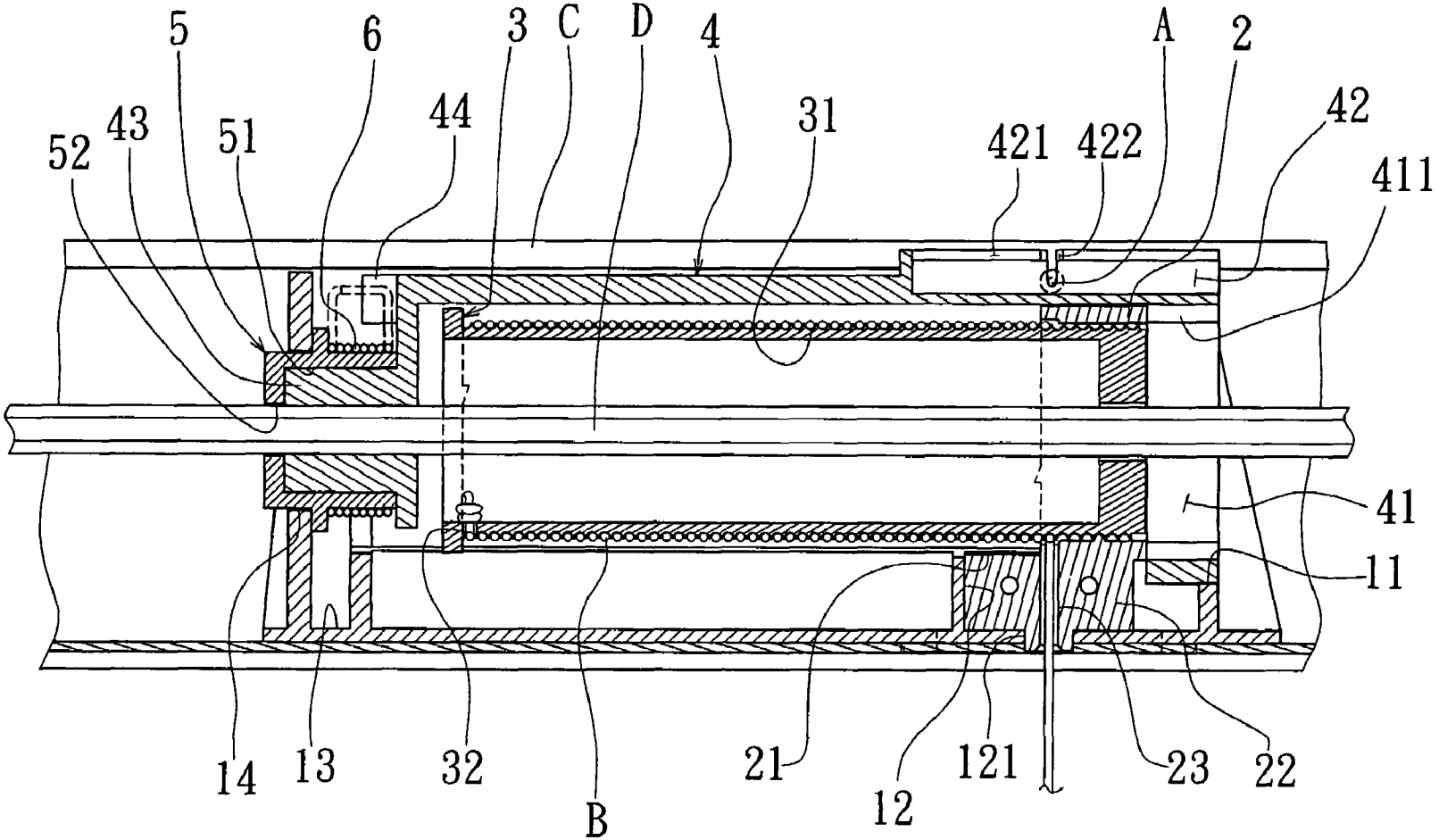
FIG. 8 is a partial front sectional view of the present device.
Figure 9:
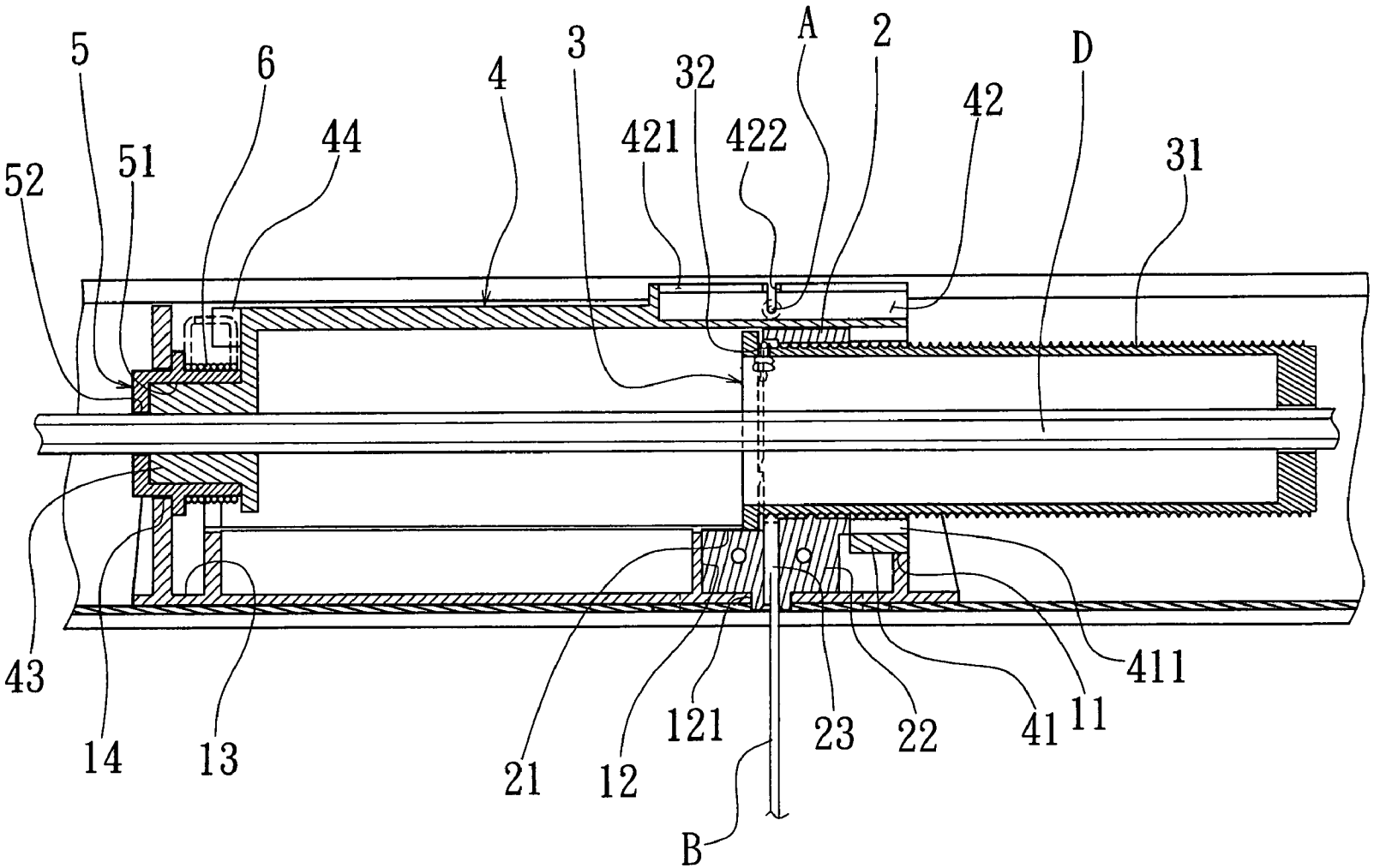
FIG. 9 is a partial front sectional view of the present tilt and lift device being operated to lower the Venetian blind.
Figure 10:
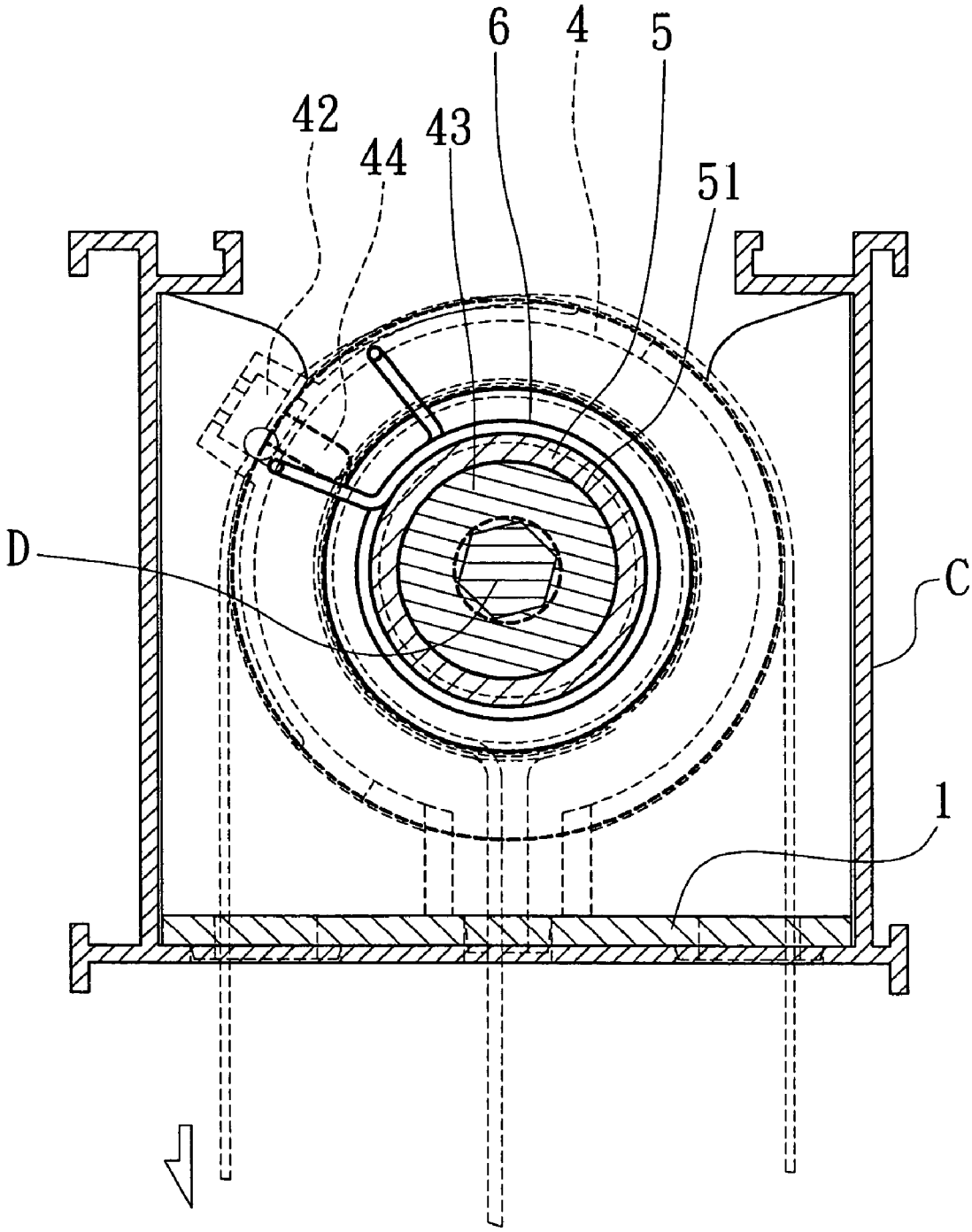
FIG. 10 is a side sectional view of the present device being operated to move the slats to the vertical position.
Figure 11:
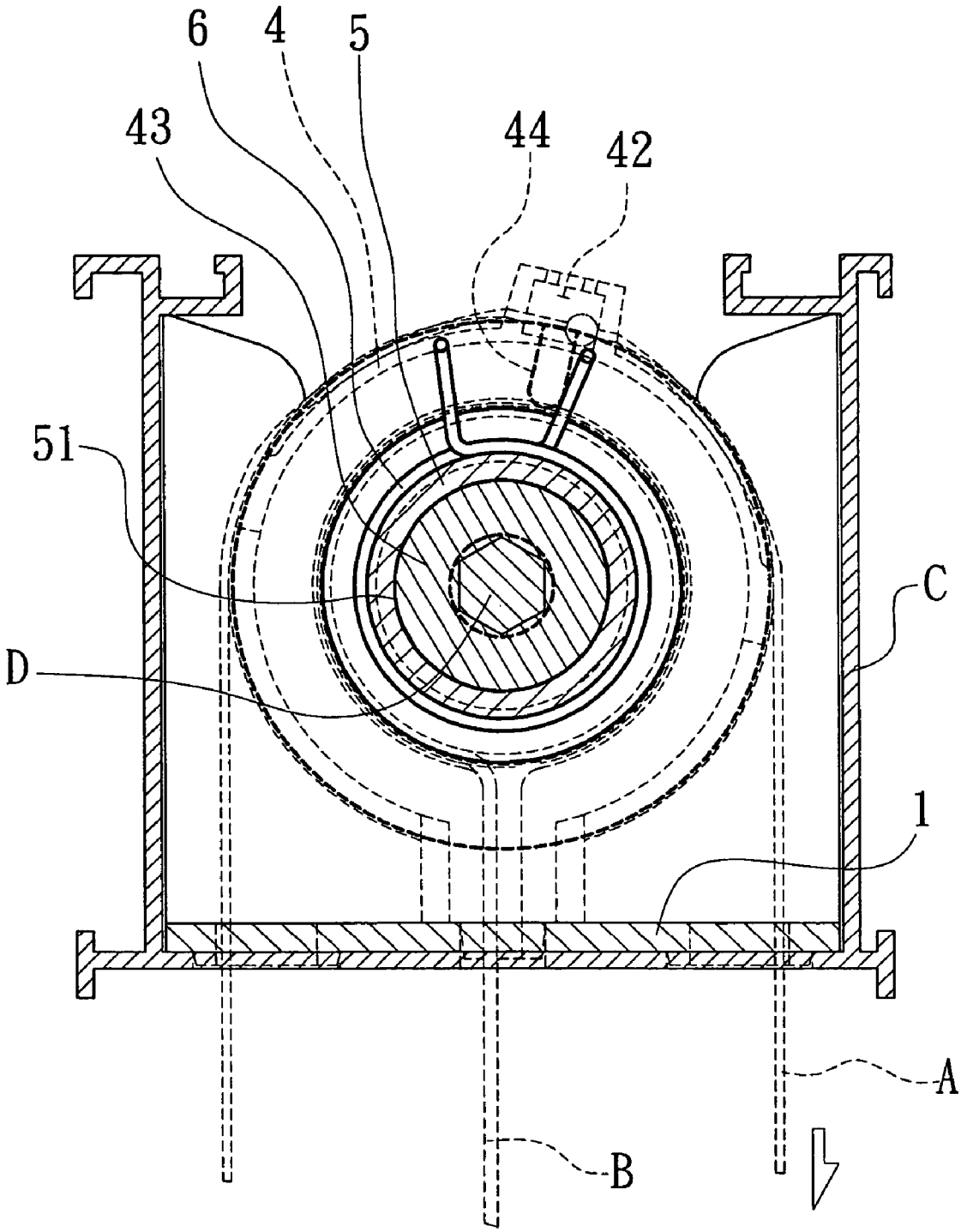
FIG. 11 is a side sectional view of the present device being operated to move the slats away from the vertical position.

Referring to FIGS. 6 and 8, a preferred embodiment of a tilt and lift device of a Venetian blind includes a manual control member (not shown), a supporting base 1, a support ring 2, a reel tube 3, an external tube 4, a rotary ring 5, and a square transmission shaft (D).

The manual control member is secured on an uppermost part of a door (window), and connected to one end of the transmission shaft (D) such that the transmission shaft (D) can be turned in a desired direction by means of operating the manual control member.

The supporting base 1 is securely held in a horizontal elongate beam (C) secured on an upper part of the door (window), and it has a concave locating portion 11 at one end, a fitting gap 12, a locating portion 14 at the other end, and a receiving space 13 next to the locating portion 14.

The support ring 2 has a hole 21, an internal thread, a fitting protrusion 22, and a through hole 23 on the fitting protrusion 22. The support ring 2 is passed into the fitting gap 12 of the supporting base 1 at the fitting protrusion 22 thereof, and securely joined to the supporting base 1.

The rotary ring 5 has a receiving hole 51 in a first end, a square hole 52 in a second end, which communicates with the receiving hole 51, and an annular protrusion 53 on an outer side. A torsion spring 6, which has two ends for exerting force on, is tightly positioned on the first end of the rotary ring 5.

The external tube 4 has an axial hole 41, bar-shaped protrusions 411 spaced apart on an inner side, a pivotal cylindrical portion 43 on a first end, a stopping protrusion 44 near to the first end on the outer side, and two elongate protrusions on an outer side, which are parallel to the axis of the external tube 4, and define a tunnel 42 between them; elongate sides of the elongate protrusions are folded inwards such that a lengthways-extending aperture 421 is formed between the elongate sides of the elongate protrusions. Furthermore, the elongate protrusions of the external tube 4 are formed with gaps 422.

Figure 7:
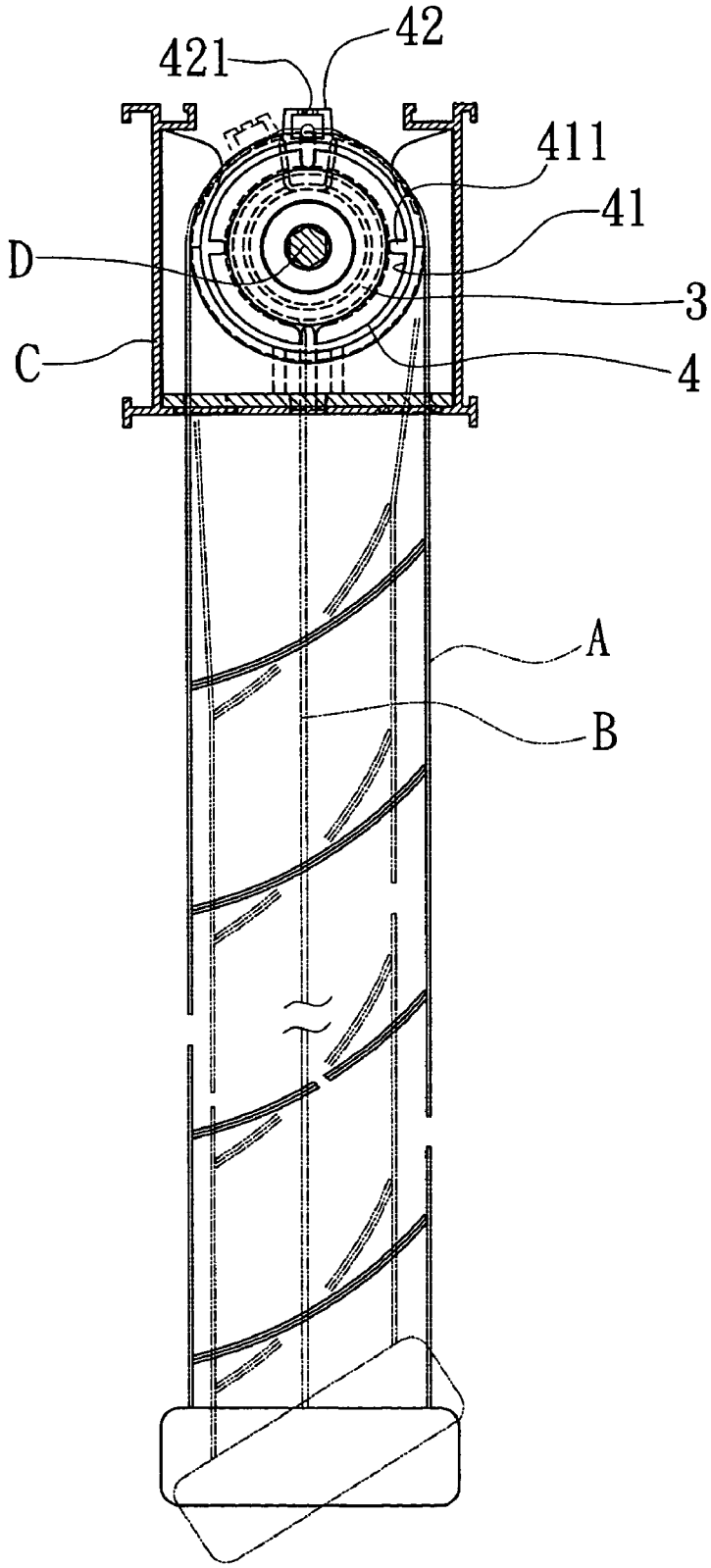
FIG. 7 is a side view of the Venetian blind of the invention, with the slats being adjusted in the tilt angle.

The rotary ring 5 is positioned on the pivotal cylindrical portion 43 of the external tube 4 with the two ends thereof being on two sides of the stopping protrusion 43. The external tube 4 is positioned horizontal on the supporting base 1 with the rotary ring 5 being passed into the locating portion 14 of the supporting base 1, and with the annular protrusion 53 of the rotary ring 5 being passed into the receiving space 13 of the supporting base 1. And, the external tube 4 is supported on the support ring 2. Thus, the external tube 4 can be turned around its central axis. A tilt cord (A), which has a knot in a middle portion, is passed over the external tube 4, and passed through the gaps 422 of the elongate protrusions of the external tube 4 at two ends with the knot being detained in the tunnel 42; thus, the tilt cord (A) will certainly be moved when the external tube 4 is turned. The tilt cord (A) is further joined to front edges of the slats of a Venetian blind at a front portion, and joined to rear edges of the slats at a rear portion, as shown in FIG. 7.

The reel tube 3 has a square axial hole (not numbered), a continuous spiral groove 31 on an outer side, and a hole 32 near to a first end. A lift cord (B) is passed through the hole 32, and formed with a knot so as not to separate from the reel tube 3 at the inner end, and it is wound along the continuous spiral groove 31 of the reel tube 3. The reel tube 3 is positioned in the axial hole 41 of the external tube 4, with the bar-shaped protrusions 411 helping the reel tube 3 keep balance, and passed through the support ring 2, and the lift cord (B) is passed through the through hole 23 of the fitting protrusion 22 of the support ring 2 at the other end, passed through the slats of the Venetian blind, and joined to a lowermost one of the slats, as shown in FIG. 7.

The square transmission shaft (D) is passed through the external tube 4, and the square holes of both the reel tube 3 and the rotary ring 5 such that the reel tube 3 and the rotary ring 5 will always turn together with the transmission shaft (D).

Thus, height and tilt angle of the Venetian blind can be changed by means of operating the manual control member to turn the transmission shaft (D). Because of the external continuous spiral groove 31 of the reel tube 3 and the internal thread of the support ring 2, the reel tube 3 will move linearly relative to the support ring 2 when it is turned.

If the user wants to adjust both the height and the tilt angle of the Venetian blind, he should first adjust the height of the Venetian blind. When the height of the Venetian blind is being adjusted by means of operating the manual control member, one of the two ends of the torsion spring 6 will be pressed against the stopping protrusion 44 of the external tube 4, and in turn the external tube 4 is turned to such a position that the two elongate protrusions of the external tube 4 come into contact with a lower portion of the supporting base 1; thus, the external tube 4 is stopped from turning further, and the torsion spring 6 is slightly enlarged, and loosens its grip on the rotary ring 5 with said one of the two ends thereof being pressed against the stopping protrusion 44, and in turn the rotary ring 5, the transmission shaft (D), and the reel tube 3 are still free to turn together. After the Venetian blind has been adjusted to a desired height, the user should operate the manual control member to make the external tube 4 slightly turn in a direction opposite to the last one such that the slats of the Venetian blind are adjusted to a desired tilt angle.

Figure 12:
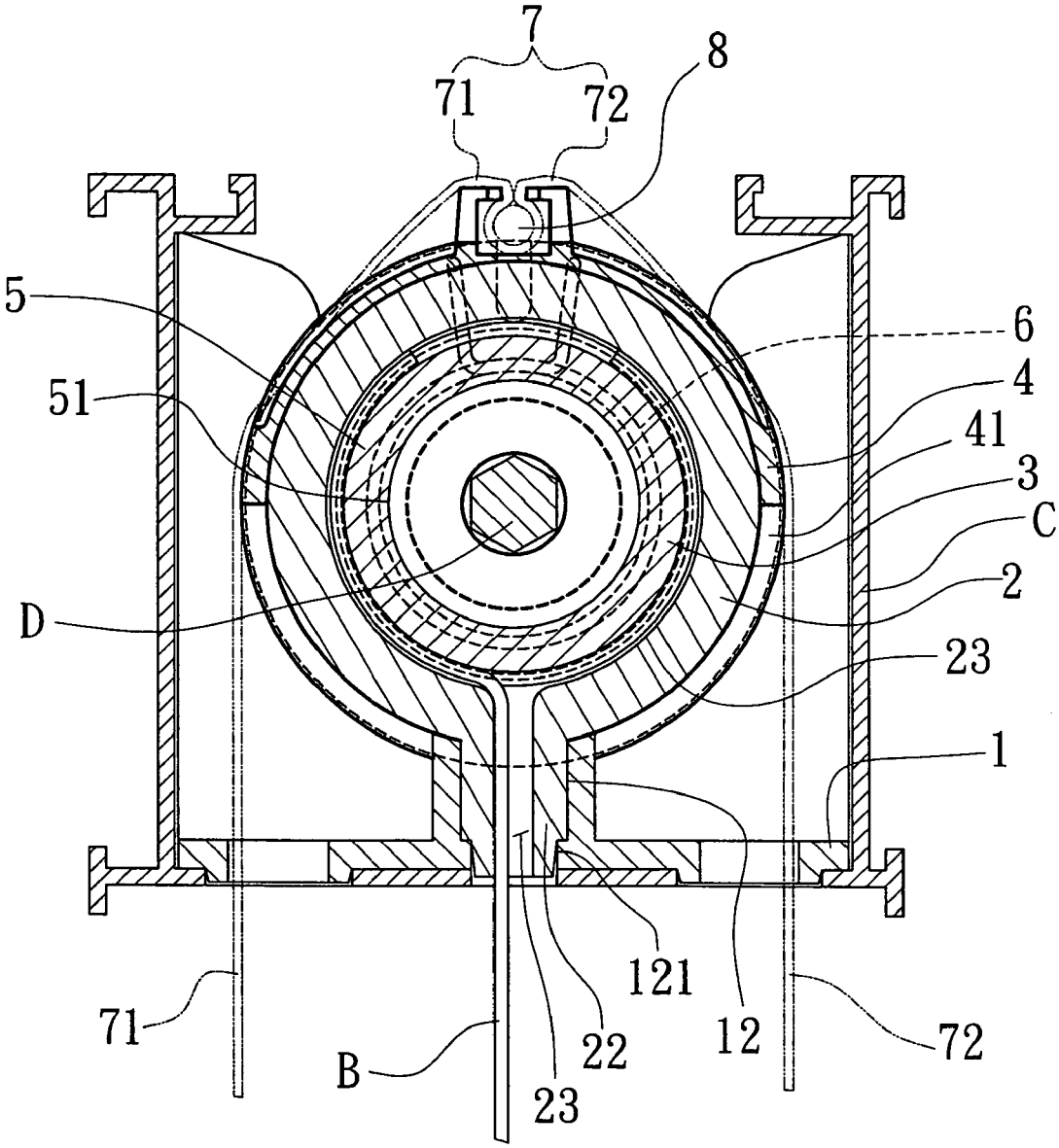
FIG. 12 is a vertical section of another preferred embodiment of the present invention, which has a tilt band instead.

Referring to FIG. 12, a second preferred embodiment of the invention is equipped with a tilt band 7 instead of the tilt cord (A); the tilt band 7 is folded and passed through the lengthways-extending aperture 421 and into the tunnel 42 between the two elongate protrusions of the external tube 4, and a pin 8 is inserted into the tunnel 42; the tilt band 7 has a front portion 71 connected to front edges of the slats of the Venetian blind, and a rear portion 72 connected to rear edges of the slats. Thus, the tilt band 7 can't possibly separate from the external tube 4 when the manual control member is used to adjust the Venetian blind. And, the tilt and lift device can be used with large and heavy Venetian blinds because it has the tilt band 7 instead.

From the above description, it can be easily seen that the tilt and lift device of the present invention has the following advantages:

1. When a thicker tilt cord is used instead of the original one, and the manual control member is operated, the tilt cord still will be certainly moved together with the external tube. And, when a thicker lift cord is used instead of the original one, the thick lift cord won't be jammed between the external tube and the reel tube. Therefore, the tilt and lift device of the invention can be used with a large and heavy Venetian blind.

2. After the external tube is angularly displaced to adjust the tilt angle of the slats of the Venetian blind, it will be firmly held in position owing to the torsion spring, which is tightly positioned on the rotary ring, and which is pressed against the stopping protrusion of the external tube. Therefore, even if the Venetian blind has relatively wide and heavy slats, the slats won't move away from the adjusted position owing to gravity.

3. Any thickness of tilt cord can be used on the present device because the way it is connected to the external tube ensures it always will be moved together with the external tube.

4. The middle portion of the tilt cord is passed into the gaps on the two elongate protrusions of the external tube therefore it won't move relative to the elongate protrusions.

5. The external tube of the present tilt and lift device allows a tilt band to be connected thereto instead of the original tilt cord. Therefore, the tilt and lift device can be adapted for use with large and heavy Venetian blinds by means of replacing the original tilt cord with a wider and stronger tilt band.

What is claimed is:

1. A tilt and lift device of a Venetian blind comprising:

a manual control member secured on an uppermost part of a window;

a polygonal transmission shaft joined to the manual control member so that the polygonal transmission shaft is operatively coupled with the manual control member;

a supporting base secured on the uppermost part of the window, the supporting base having first and second locating portions on two ends, the supporting base having a fitting gap on a bottom and a receiving space next to the second locating portion;

a support ring secured on the supporting base with a fitting protrusion thereof being disposed in the fitting gap of the supporting base, the support ring having an internal thread and a through hole communicating with the fitting gap of the supporting base;

a rotary ring passed through the second locating portion of the supporting base, an external annular protrusion held in the receiving space of the supporting base, an axial receiving hole at a first end and a polygonal hole aligned and communicating with the receiving hole;

a torsion spring tightly positioned on the first end of the rotary ring, the torsion spring having two ends for exerting force;

an external tube, the external tube being supported on the support ring at one end, disposed in the axial receiving hole of the rotary ring at a pivotal cylindrical protrusion formed on an opposing end and being angularly displaceable about a central axis thereof, the external tube having an external stopping protrusion formed near the pivotal cylindrical protrusion and held between the two ends of the torsion spring, the external tube having two elongate protrusions parallel to an axis thereof on an outer side, the elongate protrusions defining a tunnel therebetween, defining a lengthways-extending aperture between edges thereof and being formed with opposing gaps on the edges thereof;

a tilt cord disposed over, and joined to the external tube and having a knot formed on a middle portion thereof and being contained in the tunnel of the external tube, the tilt cord being disposed in the gaps of the elongate protrusions of the external tube at two ends thereof and being joined to front edges of slats of a Venetian blind at a front portion, and joined to rear edges of the slats at a rear portion;

a reel tube located internal the external tube and the support ring, the reel tube having a polygonal axial hole and having a continuous spiral groove on an outer surface;

a lift cord joined to one end of the reel tube at one end thereof and wound along the external continuous spiral groove of the reel tube, the lift cord being disposed through the through hole of the support ring, the slats of the Venetian blind, and joined to a lowermost one of the slats;

the polygonal transmission shaft being disposed through the external tube, the polygonal axial hole of the reel tube, the polygonal hole and the axial receiving hole of the rotary ring;

whereby, the reel tube and the rotary ring turn together with the transmission shaft responsive to the manual control member being operated, the external continuous spiral groove of the reel tube engaging the internal thread of the support ring such that the reel tube will move linearly relative to the support ring when it is turned, one of the two ends of the torsion spring disposed against the external stopping protrusion of the external tube to exert a pushing force thereon when the transmission shaft is turned.

2. The tilt and lift device of a Venetian blind as claimed in claim 1, wherein the external tube is formed with a plurality of bar-shaped protrusions on an inner side thereof.

3. The tilt and lift device of a Venetian blind as claimed in claim 1, wherein the tilt cord is a tilt band, which is disposed though the lengthways-extending aperture and into the tunnel between the two elongate protrusions of the external tube, and a pin is inserted into the tunnel to prevent the tilt band from falling off the external tube.

* * * * *